US010077656B1

(12) United States Patent
Sun et al.

(10) Patent No.: US 10,077,656 B1
(45) Date of Patent: Sep. 18, 2018

(54) IN-SITU CULTIVATION SYSTEM OF DEEP-SEA HYDROTHERMAL METALLIC SULFIDE DEPOSITS

(71) Applicant: Qingdao Institute of Marine Geology, Qingdao (CN)

(72) Inventors: Zhilei Sun, Qingdao (CN); Xunhua Zhang, Qingdao (CN); Lei Guo, Qingdao (CN); Luning Shang, Qingdao (CN); Wei Geng, Qingdao (CN); Hong Cao, Qingdao (CN)

(73) Assignee: Qingdao Institute of Marine Geology, Qingdao (CN)

( * ) Notice: Subject to any disclaimer, the term of this patent is extended or adjusted under 35 U.S.C. 154(b) by 0 days.

(21) Appl. No.: 15/972,235

(22) Filed: May 7, 2018

(51) Int. Cl.
*E21C 50/00* (2006.01)
*E21B 43/01* (2006.01)
*B63C 11/52* (2006.01)

(52) U.S. Cl.
CPC ..... *E21C 50/00* (2013.01); *B63C 11/52* (2013.01); *E21B 43/01* (2013.01)

(58) Field of Classification Search
CPC ..... E21C 50/00
See application file for complete search history.

(56) References Cited

U.S. PATENT DOCUMENTS 9,359,870 B2 * 6/2016 Takai ..... E21C 50/00
2016/0060779 A1 * 3/2016 Baird ..... C25C 1/12
205/771

FOREIGN PATENT DOCUMENTS

GB 2391881 A * 2/2004 ..... E02F 3/88
WO WO-2016147419 A1 * 9/2016 ..... E21B 43/00

* cited by examiner

*Primary Examiner* — John J Kreck
(74) *Attorney, Agent, or Firm* — Gokalp Bayramoglu

(57) ABSTRACT

An in-situ cultivation system of a deep-sea hydrothermal metallic sulfide deposits includes a hydrothermal metallic sulfide deposit mound body, a well casing, a well head control flow guide device, a fluid mixing control hood; the hydrothermal metallic sulfide deposit mound body includes a confining bed, a hydrothermal fluid enriching bed and mound body bedrock; perforations are formed at casing wall of the well casing; the well head flow control device is provided at top of the well casing; a lower opening is formed at bottom of the fluid mixing control hood and is sleeved on four sides of the top of the well casing; an upper opening is formed at top of the fluid mixing control hood; a plurality of fluid holes are formed at a lateral wall of the fluid mixing control hood; and a sulfide coating is applied to inner wall of the fluid mixing control hood.

17 Claims, 2 Drawing Sheets

IN-SITU CULTIVATION SYSTEM OF DEEP-SEA HYDROTHERMAL METALLIC SULFIDE DEPOSITS

CROSS REFERENCE TO THE RELATED APPLICATIONS

The present application is based on and claims priority to the Chinese patent application 201710228147.X, filed on Apr. 10, 2017, the entire contents of which are incorporated herein by reference.

TECHNICAL FIELD

The present invention relates to the technical field of exploration and exploitation of deep-sea metallic sulfides, in particular to an in-situ cultivation system of deep-sea hydrothermal metallic sulfide deposits.

BACKGROUND

Deep-sea hydrothermal metallic sulfide deposits are metallic mineral resources with a strategic significance in modern times, including metallic elements such as iron, copper, lead, zinc, nickel, cobalt, gold, silver, platinum. Those deposits are distributed in global oceans from hundreds of meters to 4,000 meters deep, and are mainly focused at mid-ocean ridges, back-arc basins and formation mobile fault zones. According to preliminary estimates, some 900 individual hydrothermal metallic sulfide deposits are totally cultivated at the sea floors of the oceans in the world, and some 160 deposits have been found at present. The preliminary estimates on the deposits at several mid-ocean ridges show that the scale usually ranges from 1 million tons to 0.1 billion tons, which reflects that hydrothermal deposits have a considerable resource inventory. Compared with deep-sea polymetallic nodules or cobalt-rich crusts, the sea-floor hydrothermal sulfides have advantages of small water depth, high quality, easy exploitation, beneficiation and smelting. Therefore, the investigation, research and development activities are significant for human society which faces resources shortages increasingly.

In the 1960s, the development of sea-floor metallic sources boomed, including polymetallic nodules, cobalt-rich crusts and hydrothermal metallic sulfide deposits. A great progress has been made after decades of research and development. Even so, there are still difficulties in the exploitation of the deep-sea metallic sulfides at present, mainly including the following aspects. 1) High exploitation cost: The quality of the sea-floor sulfides is high, but if the sea-floor sulfides does not reach a certain exploitation scale, the cost is inevitably higher than the land exploitation, and the cost in the ore transport and in the recycling and smelting of metals such as silver, copper, zinc, lead, etc. are also relatively high. 2) Conventional concept and immature technologies: The exploitation technologies and experience of the deep-sea polymetallic nodules, cobalt-rich crusts and deep-sea oil gases can only serve as references of the exploitation of the hydrothermal sulfides, so new approaches are in need, and aiming at the formation features of the sea-floor deposit, innovative ideas are required to design more reasonable and pertinent exploration and exploitation solutions. 3) Environmental risks: Once submarine mining enters the implementation stage, risks will be inevitably brought to the marine environment, including water pollution and submarine landslide, in particular possible damage to the unique biotic and ecological communities of the hydrothermal zones, thus resulting in ecological disasters.

SUMMARY

The objective of the present invention is to provide an in-situ cultivation system of deep-sea hydrothermal metallic sulfide deposits, which makes a full use of the natural factors to cultivate the deep-sea hydrothermal metallic sulfide deposits so as to reduce the exploitation cost and avoid environmental pollution.

The present invention provides an in-situ cultivation system of a deep-sea hydrothermal metallic sulfide deposits. The system includes a hydrothermal metallic sulfide deposit mound body, a well casing, a well head control flow guide device, a fluid mixing control hood; the well casing is penetrated into the hydrothermal metallic sulfide deposit mound body; the hydrothermal metallic sulfide deposit mound body includes a confining bed, a hydrothermal fluid enriching bed and mound body bedrock in turn from the outside to the inside; perforations are formed at the casing wall of the well casing that is positioned at the hydrothermal fluid enriching bed; the well head flow control device is provided at the top of the well casing; a lower opening is formed at the bottom of the fluid mixing control hood; the lower opening is sleeved on the four sides of the top of the well casing; an upper opening is formed at the top of the fluid mixing control hood; a plurality of fluid holes are formed at a lateral wall of the fluid mixing control hood; and a sulfide coating is applied to the inner wall of the fluid mixing control hood.

Further, the well head control flow guide device comprises a barometric flow control valve and a fluid temperature meter; the barometric flow control valve is disposed on the well casing; and a temperature sensing end of the fluid temperature meter is disposed at an outlet of the top of the well casing.

Further, the fluid mixing control hood is a round table structure; a lower round opening is formed in the center of the round bottom face of the fluid mixing control hood with the round table structure; and an upper round opening is formed at a sharp tip of the fluid mixing control hood with the round table structure.

Further, the round bottom face of the fluid mixing control hood with the round table structure has a diameter of 16 m and a height of 20 m; the lower round opening has a diameter of 6 m, and the upper round opening has a diameter of 4 m.

Further, a stainless steel outer layer is disposed on the outer wall of the fluid mixing control hood.

Further, a large particle filtering screen is disposed at the outlet of the top of the well casing.

Further, a well head support which is erected on the sea floor is disposed at the top of the well casing.

Further, the well casing is filled in with a cement well wall on the outer side.

Further, the in-situ cultivation system of a deep-sea hydrothermal metallic sulfide deposits also comprises a mobile drilling platform; the mobile drilling platform exploits and drills the hydrothermal metallic sulfide mound body by using a drill stem to form a natural well; and the well casing is inserted into the natural well to run through the hydrothermal metallic sulfide mound body.

Further, the mobile drilling platform comprises a drilling engineering ship and a drilling platform which is disposed on the drilling engineering ship.

Compared with the prior art, the in-situ cultivation system of deep-sea hydrothermal metallic sulfide deposits of the present invention has the following features and advantages:

1. The in-situ cultivation system of deep-sea hydrothermal metallic sulfide deposits of the present invention induces nucleation through control over factors such as the temperature, flow rate and pressure of mixed fluids, capable of effectively improving ore quality and enhancing economical benefits.

2. The in-situ cultivation system of deep-sea hydrothermal metallic sulfide deposits of the present invention makes a full use of the natural factors to cultivate the deep-sea hydrothermal metallic sulfide deposits, without any maintenance cost in the growth process.

3. The in-situ cultivation system of deep-sea hydrothermal metallic sulfide deposits of the present invention does not need large-scale sea-floor exploitation, greatly reduces environmental risks, and avoids environmental pollution.

The features of the advantages of the present invention become more apparent and clear when read in conjunction with the embodiments of the present invention.

BRIEF DESCRIPTION OF THE DRAWINGS

The present utility model is detailed in conjunction with the drawings and the embodiments below.

To clearly describe the technical solution in the embodiments of the present disclosure or in the prior art, the following are brief introduction of the attached drawings used to describe the technology in the embodiments or in the prior art. Obviously, the attached drawings described below involve some embodiments of the present disclosure. For those originally skilled in this art, other drawings can be made according to those drawings without creative labor.

Figure 1:
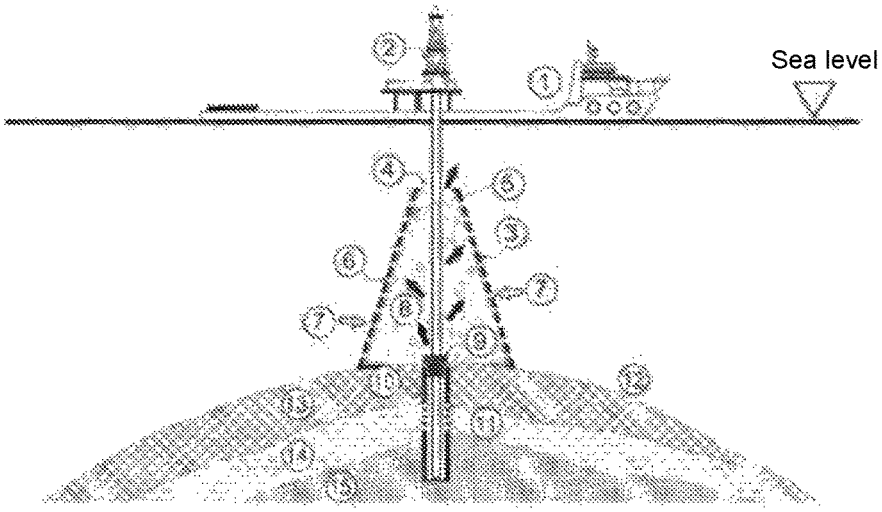
FIG. 1 is a schematic view of in-situ cultivation system of deep-sea hydrothermal metallic sulfide deposits in an embodiment of the present invention.

In the drawings, 1—drilling engineering ship; 2—drilling platform; 3—fluid mixing control hood; 4—upper opening; 5—sulfide coating; 6—fluid hole; 7—sea water; 8—hydrothermal fluid; 9—well head control flow guide control device; 91—hydrothermal fluid nozzle; 92—valve instrument console; 93—barometric flow control valve; 94—fluid temperature meter; 95—well head support; 96—large particle filtering screen; 97—cement well wall; 98—natural well; 99—sea floor; 10—well casing; 11—perforation; 12—hydrothermal metallic sulfide mount body; 13—confining bed; 14—hydrothermal fluid enriching bed; 15—mount body bedrock.

DETAILED DESCRIPTION

Hydrothermal black smoker chimneys of sea-floor metallic sulfide deposits are formed after high-temperature, reducing hydrothermal fluid 8 that contains metallic elements such as iron, copper and zinc and erupts from a hydrothermal spray nozzle of a hydrothermal metallic sulfide mount body 12 is mixed with the surrounding cold, oxidizing sea water 7 and then perform deposition. "Separation" effect occurs in the lower reacting zone, so the high-temperature hydrothermal fluid 8 has very high buoyancy in comparison with the sea water 7 and therefore can be quickly erupted from the sea floor. When the temperature of the high-temperature hydrothermal fluid 8 is higher than 350° C., the main products are black smoker chimneys constituted by copper-rich sulfides and sulfates; when the temperature of the high-temperature hydrothermal fluid 8 is within the range of 100-350° C., the main products are white smoker chimneys constituted by silicious substances, sulfates and a small amount of Zn-rich sulfides and marcasite.

The model established after study on the black smoker chimneys in the 21° N EPR region is still used today. This model represents that the formation of the smoker chimneys is obviously divided into two stages: first, when the high-temperature hydrothermal fluid 8 which has weak acidity and is rich in metals, sulfides and Ca is mixed with the surrounding cold (some 2° C.) sea water 7 which has weak alkalinity and is insufficient in metals and sulfates and rich in Ca, anhydrite ($CaSO4$) and fine Fe, Zn as well as Cu—Fe metallic sulfides perform deposition. Annular anhydrite deposits generated around the spray nozzle retard the direct mixing between the hydrothermal liquid and the sea water 7, and provide a base for the deposition of other minerals; stage 2, in a channel formed by the annular anhydrite, copper pyrites ($CuFeS2$) start to deposit, while the hydrothermal fluid 8 and the sea water 7 diffuse and flow toward each other through the newly formed, puff, porous chimney wall. In the above-mentioned processes, the sulfides and sulfates are saturated and deposited in pores of the chimney wall, so the permeability of the chimney wall is lowered. Under the condition that the chimney channel keeps smooth continuously, a part of the fluid flows through the top and enters the sea water 7, forming relatively large-scale hydrothermal plumes and resulting in deposition of a large amount of minerals. Thus, a complete hydrothermal chimney is formed.

According to the above mineralization principle, in order to achieve the objectives of controlling the chimney growth and facilitating exploitation, this embodiment provides an in-situ cultivation system of deep-sea hydrothermal metallic sulfide deposits, which simulates the low-temperature gypsum and sulfate outer wall formed in the early stage, and achieves the objective of controlling the temperature of the fluid in the chimney and the growth rate of the minerals. The in-situ cultivation system of deep-sea hydrothermal metallic sulfide deposits in this embodiment includes functional units such as a mobile drilling platform, a well casing 10, a well head control flow guide device 9 and a fluid mixing control hood 3.

Figure 2:
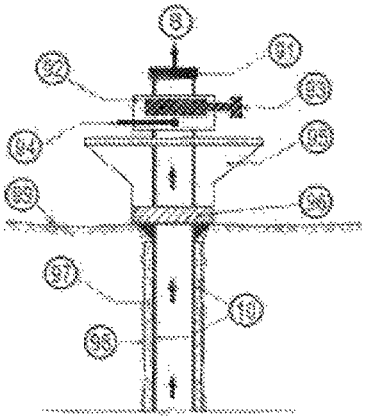
FIG. 2 is a schematic view of a part structure of in-situ cultivation system of deep-sea hydrothermal metallic sulfide deposits in an embodiment of the present invention.
Figure 3:
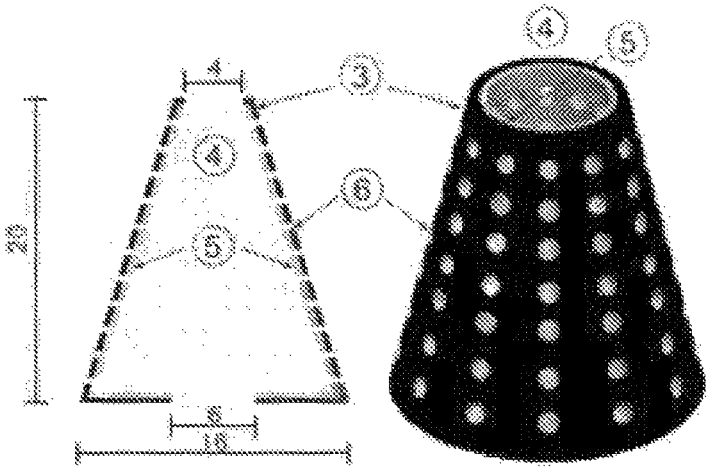
FIG. 3 is a schematic view of a fluid mixing control hood in an embodiment of the present invention.

As shown in FIG. 1-FIG. 3, the mobile drilling platform includes a drilling engineering ship 1 and a drilling platform 2 disposed on the drilling engineering ship 1; the drilling platform 2 drills a hydrothermal metallic sulfide mound body 12 by using a drilling stem to form a natural well 98; and the well casing 10 is inserted into the natural well 98 to run through the hydrothermal metallic sulfide mound body 12. The hydrothermal metallic sulfide deposit mound body 12 includes a confining bed 13, a hydrothermal fluid enriching bed 14 and mound body bedrock 15 in turn from the outside to the inside, and perforations 11 are formed at the casing wall of the well casing 10 that is positioned at the hydrothermal fluid enriching bed 14. A well head control flow guide device 9 is disposed at the top of the well casing 10. The well head control flow guide device 9 includes a barometric flow control valve 93 and a fluid temperature meter 94; the barometric flow control valve 93 is disposed on the well casing 10 and is configured on a valve instrument console 92; and a temperature sensing end of the fluid temperature meter 94 is disposed at an outlet of the top of the well casing 10. A large particle filtering screen 96 is disposed at the outlet of the top of the well casing 10; a hydrothermal fluid spray nozzle 91 is connected to the well casing 10; a well head support 95 which is erected on the sea floor 99 is disposed at the top of the well casing 10; and a cement well wall 97 is disposed between the outer side of the well casing 10 and the natural well 98. The fluid mixing control hood 3 is a round table structure; a lower round opening is formed in the center of the round bottom face of the fluid mixing control hood 3 with the round table structure; an upper round opening 4 is formed at a sharp tip of the fluid mixing control hood 3 with the round table structure; and a stainless steel outer layer with a thickness of 2 cm is disposed on the outer wall of the fluid mixing control hood 3. In this embodiment, the round bottom face of the fluid mixing control hood 3 with the round table structure has a diameter of 16 m and a height of 20 m; the lower round opening has a diameter of 6 m, and the upper round opening 4 has a diameter of 4 m. The lower opening of the fluid mixing control hood 3 is sleeved on the four sides of the top of the well casing 10; the upper opening 4 is formed at the top of the fluid mixing control hood 3; a plurality of fluid holes 6 are formed on a lateral wall of the fluid mixing control hood 3; the sizes and quantity of the fluid holes 6 can be regulated according to the flow rate and temperature of the hydrothermal fluid 8; hotter hydrothermal fluid 8 leads to larger and more fluid holes 6; vice versa, smaller and fewer holes are obtained. The surrounding cold sea water 7 can enter via the fluid holes 6 to be mixed with the high-temperature hydrothermal fluid 8 in the fluid mixing control hood 3. A sulfide mineral coating 5 with a thickness of 1 cm is applied to the inner wall of the fluid mixing control hood 3, for example pyrites, copper pyrites, lead zinc ores and zinc blends, so as to control the generation of the mineral elements in the principle of nucleation induction. The fluid mixing control hood 3 can overall reduce the rate of diffusion of the high-temperature hydrothermal fluid 8 towards the sea water 7 in the surroundings, keep a relatively high temperature such that the hydrothermal fluid 8 quickly nucleate to form minerals on the sulfide mineral coating 5, and at the same time, effectively reduce the ratio of the low-temperature minerals (such as gypsum and opal) with a relatively poor economical significance in the minerals, thus making sure that a high-temperature fluid channel is formed in the center in the early stage of mineralization, and ensuring that the fluid on the floor is continuously supplied upward via the well casing 10.

In this embodiment, the in-situ cultivation system of deep-sea hydrothermal metallic sulfide deposits performs production according to the following procedure: with the support of the drilling engineering ship 1, the drilling platform 2 drills the hydrothermal metallic sulfide mount body 12, pierces the confining bed 13, enters the hydrothermal fluid enriching layer 14, and usually at last, needs to form the natural well 98 at the end hole of the mount body bedrock 15. After finishing drilling, the drilling stem retracts. The drilling stem shown in FIG. 1 is mainly illustrative, and is not included in the subsequent system. The well casing 10 is inserted into the natural well 98 to run through the hydrothermal metallic sulfide mount body 12, and guided by the perforations 11 at the hydrothermal fluid enriching layer 14, the hydrothermal fluid 8 enters the well casing 10. After the large particle filtering screen 96 screens out large particles which may block the well casing 10, the hydrothermal fluid 8 enters the fluid mixing control hood 3 via the well head control flow guide device 9. The flow rate and pressure of the hydrothermal fluid 8 can be regulated with the barometric flow control valve 93 in the well head control flow guide device 9 so as to obtain the optimal hydrothermal fluid 8. In addition, the temperature of the hydrothermal fluid 8 can be measured in situ with the fluid temperature meter 94 so as to facilitate the selection of the fluid mixing control hood 3 with proper sizes and density of the fluid holes 6, thus ensuring effective control over the mixing process of the surrounding sea water 7 and the hydrothermal fluid 8, maintaining a certain temperature in the fluid mixing control hood 3, and ensuring fast nucleation and mineralization on the inner sulfide mineral coating 5. In this embodiment, the round bottom face of the fluid mixing control hood 3 with the round table structure has a diameter of 16 m and a height of 20 m; the lower round opening has a diameter of 6 m, and the upper round opening 4 has a diameter of 4 m. When the temperature of high-temperature fluid is greater than 300 DEG. C, it is predicted that it takes some 6-12 months to fully fill the metallic sulfides in the fluid mixing control hood 3. After the drilling is completed, the fluid mixing control hold 3 can be distributed and placed with a sea-floor engineering robot. After one cultivation cycle is finished, the cutting of the hood bottom of the fluid mixing control hood 3 can be automatically controlled with the engineering robot, and then round table-shaped sulfide minerals can be hoisted to the sea level with the engineering ship platform, thus completing a cultivation cycle.

In this embodiment, the in-situ cultivation system of deep-sea hydrothermal metallic sulfide deposits does not need any maintenance cost in the growth process except for some cost in the launching and cutting procedures. Large-scale submarine exploitation is not needed, so the environmental risks are greatly reduced. In addition, nucleation can be induced through controlling factors such as temperature, flow rate and pressure of the mixed fluids, capable of effectively improving the mineral quality, enhancing the contents of elements including Cu, Zn and Fe, and enhancing economical benefits. Considerable benefits can be obtained if dozens or hundreds of deep-sea hydrothermal metallic sulfide deposits are cultivated in a common hydrothermal fluid field (some hundreds of square meters to several square kilometers) at the same time. The proposal and application of the in-situ cultivation system of deep-sea hydrothermal metallic sulfide deposits is a symbol that human beings enters an integrated cultivation stage, where more controls can be implemented, of exploring and exploiting the deep-sea mineral products from the nomadic stage with many blind work.

The above description does not limit the present invention. The present invention is not limited to the above embodiments. All changes, modifications, additions or replacements made by those skilled in the art within the principle of the present invention shall also fall within the protective scope of the present invention.

What is claimed is:

1. An in-situ cultivation system of deep-see hydrothermal metallic sulfide deposits, comprising:

a hydrothermal metallic sulfide deposit mound body, a well casing, a well head control flow guide device, and a fluid mixing control hood;

wherein, the well casing is penetrated into the hydrothermal metallic sulfide deposit mound body;

the hydrothermal metallic sulfide deposit mound body comprises a confining bed, a hydrothermal fluid enriching bed and a mound body bedrock in sequence from an outside to an inside direction;

perforations are formed at a casing wall of the well casing positioned at the hydrothermal fluid enriching bed;

the well head flow control device is provided at a top of the well casing;

a lower opening is formed at a bottom of the fluid mixing control hood;

the lower opening is sleeved on four sides of the top of the well casing;

an upper opening is formed at a top of the fluid mixing control hood;

a plurality of fluid holes are formed at a lateral wall of the fluid mixing control hood; and a sulfide coating is applied to the inner wall of the fluid mixing control hood.

2. The in-situ cultivation system of deep-sea hydrothermal metallic sulfide deposits according to claim 1, wherein the well head control flow guide device comprises a barometric flow control valve and a fluid temperature meter; the barometric flow control valve is disposed on the well casing; and a temperature sensing end of the fluid temperature meter is disposed at an outlet of the top of the well casing.

3. The in-situ cultivation system of deep-sea hydrothermal metallic sulfide deposits according to claim 2, further comprising a mobile drilling platform; the mobile drilling platform exploits and drills the hydrothermal metallic sulfide mound body by using a drill stem to form a natural well; and the well casing is inserted into the natural well to run through the hydrothermal metallic sulfide mound body.

4. The in-situ cultivation system of deep-sea hydrothermal metallic sulfide deposits according to claim 1, wherein the fluid mixing control hood is a round table structure; a lower round opening is formed in the center of a round bottom face of the fluid mixing control hood; and an upper round opening is formed at a sharp tip of the fluid mixing control hood.

5. The in-situ cultivation system of deep-sea hydrothermal metallic sulfide deposits according to claim 4, further comprising a mobile drilling platform; the mobile drilling platform exploits and drills the hydrothermal metallic sulfide mound body by using a drill stem to form a natural well; and the well casing is inserted into the natural well to run through the hydrothermal metallic sulfide mound body.

6. The in-situ cultivation system of deep-sea hydrothermal metallic sulfide deposits according to claim 4, wherein the round bottom face of the fluid mixing control hood has a diameter of 16 m and a height of 20 m; the lower round opening has a diameter of 6 m, and the upper round opening has a diameter of 4 m.

7. The in-situ cultivation system of deep-sea hydrothermal metallic sulfide deposits according to claim 6, further comprising a mobile drilling platform; the mobile drilling platform exploits and drills the hydrothermal metallic sulfide mound body by using a drill stem to form a natural well; and the well casing is inserted into the natural well to run through the hydrothermal metallic sulfide mound body.

8. The in-situ cultivation system of deep-sea hydrothermal metallic sulfide deposits according to claim 1, wherein a stainless steel outer layer is disposed on the outer wall of the fluid mixing control hood.

9. The in-situ cultivation system of deep-sea hydrothermal metallic sulfide deposits according to claim 8, further comprising a mobile drilling platform; the mobile drilling platform exploits and drills the hydrothermal metallic sulfide mound body by using a drill stem to form a natural well; and the well casing is inserted into the natural well to run through the hydrothermal metallic sulfide mound body.

10. The in-situ cultivation system of deep-sea hydrothermal metallic sulfide deposits according to claim 1, wherein a large particle filtering screen is disposed at the outlet of the top of the well casing.

11. The in-situ cultivation system of deep-sea hydrothermal metallic sulfide deposits according to claim 10, further comprising a mobile drilling platform; the mobile drilling platform exploits and drills the hydrothermal metallic sulfide mound body by using a drill stem to form a natural well; and the well casing is inserted into the natural well to run through the hydrothermal metallic sulfide mound body.

12. The in-situ cultivation system of deep-sea hydrothermal metallic sulfide deposits according to claim 1, wherein a well head support erected on the sea floor is disposed at the top of the well casing.

13. The in-situ cultivation system of deep-sea hydrothermal metallic sulfide deposits according to claim 12, further comprising a mobile drilling platform; the mobile drilling platform exploits and drills the hydrothermal metallic sulfide mound body by using a drill stem to form a natural well; and the well casing is inserted into the natural well to run through the hydrothermal metallic sulfide mound body.

14. The in-situ cultivation system of a deep-sea hydrothermal metallic sulfide deposits according to claim 1, wherein the well casing is filled in with a cement well wall on the outer side.

15. The in-situ cultivation system of deep-sea hydrothermal metallic sulfide deposits according to claim 14, further comprising a mobile drilling platform; the mobile drilling platform exploits and drills the hydrothermal metallic sulfide mound body by using a drill stem to form a natural well; and the well casing is inserted into the natural well to run through the hydrothermal metallic sulfide mound body.

16. The in-situ cultivation system of deep-sea hydrothermal metallic sulfide deposits according to claim 1, further comprising a mobile drilling platform; the mobile drilling platform exploits and drills the hydrothermal metallic sulfide mound body by using a drill stem to form a natural well; and the well casing is inserted into the natural well to run through the hydrothermal metallic sulfide mound body.

17. The in-situ cultivation system of deep-sea hydrothermal metallic sulfide deposits according to claim 16, wherein the mobile drilling platform comprises a drilling engineering ship and a drilling platform which is disposed on the drilling engineering ship.

* * * * *